United States Patent [19]

Iannini

[11] Patent Number: 4,742,278

[45] Date of Patent: May 3, 1988

[54] SINGLE CONNECTION GAS DISCHARGE DISPLAY AND DRIVER

[76] Inventor: Robert E. Iannini, Brook Rd., Mount Vernon, N.H. 03057

[21] Appl. No.: 57,617

[22] Filed: Jun. 3, 1987

[51] Int. Cl.[4] ..... H05B 41/16

[52] U.S. Cl. ..... 315/248; 315/227 R; 315/236

[58] Field of Search ..... 315/248, 236, 227

[56] References Cited

U.S. PATENT DOCUMENTS

| | | | |
|---|---|---|---|
| 1,819,105 | 8/1931 | Machlett et al. | 315/227 |
| 1,854,912 | 4/1932 | Spaeth | 315/248 |
| 2,629,839 | 2/1953 | GreenLee | 315/248 |
| 2,984,765 | 5/1961 | Engelbart | 315/248 |
| 3,085,189 | 4/1963 | Thonemann | 315/248 |
| 4,245,178 | 1/1981 | Justice | 315/248 |

*Primary Examiner*—Harold Dixon

*Attorney, Agent, or Firm*—Hayes, Davis & Soloway

[57] ABSTRACT

A new method and apparatus for driving a neon display tube or the like. The tube, containing an ionizable gas, has only a single cathode element at one end in contact with the gas. A power source connected to ionize the gas and cause illumination thereof wherein the power source is connected to the single cathode element and produces alternating voltage referenced to ground potential and of sufficient frequency to cause the gas to ionize through the natural surrounding capacitance between the ionized gas and ground potential. In the preferred embodiment, the power source produces an increasing voltage ramp output whereby the ionization of the gas in the tube moves as a localized ionization along the tube in a direction away from the single cathode element. The voltage ramp may start at a level to cause initial ionization of the gas adjacent the single cathode element, rise to a level to cause final ionization of the gas adjacent the end of the tube oppose the single cathode element, and rise at a rate to produce a visible progression of illumination from one end of the tube to the other whereby an illuminated handwriting effect is created by the progressive illumination of the tube. Also, the voltage ramp may start at a level to cause initial ionization of the gas at a first selected point on the tube and rise to a level to cause final ionization of the gas at a second selected point on the tube displaced from the first point whereby only a selected portion of the tube is illuminated.

41 Claims, 4 Drawing Sheets

SINGLE CONNECTION GAS DISCHARGE DISPLAY AND DRIVER

BACKGROUND OF THE INVENTION

The present invention relates to displays and, more particularly to an illuminated display comprising, an elongated cold cathode gas discharge tube containing an ionizable gas, the tube having a single cathode element at one end in contact with the gas; and, a power source connected to ionize the gas and cause illumination thereof, the power source being connected to the single cathode element and producing alternating voltage referenced to ground potential and of sufficient frequency to cause the gas to ionize through the natural surrounding capacitance between the ionized gas and ground potential.

Cold cathode gas discharge displays are old and well known in the art. The most familiar is the "neon sign" 10 of FIG. 1, which has remained virtually unchanged from time immemorial. In neon sign 10, an elongated glass tube 12 is filled with an ionizable gas 14, such as neon. The tube 12 has a pair of cathode elements 16 passing through the glass at the ends of the tube 12 into contact with the gas 14. The secondary of a high voltage, current limited transformer 18 is connected across the cathode elements 16. The primary of the transformer 18 is connected via plug 20 to a standard 110 volt, 60 Hz wall socket, or the like, which results in a 60 Hz, high voltage being applied across the gas 14 by the cathode elements 16. The high voltage causes the gas 14 to ionize and glow, thus causing the desired illumination. Particularly as the signs get older, the use of high voltage causes buzzing, and the like, which is annoying and disruptive.

Neon signs such as 10 are typically used in two ways. They can be disposed behind a display panel having indicia thereon (not shown) and used to illuminate the panel. More commonly, the tubes 12 are formed into the letters, or the like, to convey the desired message. In either case, however, the entire length of the tube 12 must be energized simultaneously. For "movement" of the display, individual tubes comprising the various segments must be employed with each connected to an individual source of power. Moreover, timing and power control circuits must typically be utilized in this approach.

Wherefore, it is the object of the present invention to provide a new approach to the manner of operation of gas discharge tubes which provides for ionization of the gas with a single cathode element.

It is another object of the present invention to provide a new approach to the manner of operation of gas discharge tubes which provides for low voltage operation thereof.

It is yet another object of the present invention to provide a new approach to the manner of operation of gas discharge tubes which provides for selective ionization and illumination of portions of the tube.

It is still another object of the present invention to provide a new approach to the manner of operation of gas discharge tubes which provides for moving illumination of the tube in an illuminated handwriting style.

Other objects and benefits of the present invention will become apparent from the description contained hereinafter in combination with the illustrative drawing figures.

SUMMARY

The foregoing objects have been achieved by the illuminated display of the present invention comprising, an elongated cold cathode gas discharge tube containing an ionizable gas and having a single cathode element at one end in contact with the gas; and, a power source connected to ionize the gas and cause illumination thereof wherein the power source is connected to the single cathode element and produces alternating voltage referenced to ground potential and of sufficient frequency to cause the gas to ionize through the natural surrounding capacitance between the ionized gas and ground potential.

In the preferred embodiment, the power source produces an increasing voltage ramp output whereby the ionization of the gas in the tube moves as a localized ionization along the tube in a direction away from the single cathode element.

Further in the preferred embodiment, the voltage ramp starts at a level to cause initial ionization of the gas adjacent the single cathode element, rises to a level to cause final ionization of the gas adjacent the end of the tube oppose the single cathode element, and rises at a rate to produce a visible progression of illumination from one end of the tube to the other whereby an illuminated handwriting effect is created by the progressive illumination of the tube.

Also in the preferred embodiment, the voltage ramp starts at a level to cause initial ionization of the gas at a first selected point on the tube and rises to a level to cause final ionization of the gas at a second selected point on the tube displaced from the first point whereby only a selected portion of the tube is illuminated.

According to one feature disclosed, the power source includes means connected to an audio source for modulating the frequency of the voltage ramp as a function of an audio signal from the audio source so that the selected illuminated portion of the tube varies as a function of the audio signal.

Additionally in the preferred embodiment, the power source includes means for setting the frequency of the voltage ramp as a function of the natural capacitance to ground of the gas whereby to automatically compensate for variations in the capacitance as more or less gas is ionized.

In one embodiment, the illuminated display of the present invention additionally comprises a display panel containing indicia thereon disposed to be illuminated by the tube and means for repeatably changing the first and second points to cause the display panel to be cyclically illuminated in portions disposed over the tube between the changing first and second points, including means for changing the points at a rate to produce a visibly perceptible stepping between the portions of the display panel being illuminated.

DESCRIPTION OF THE PREFERRED EMBODIMENT

The method of operation upon which the present invention is based requires only a single cathode element at one end of the tube. This is possible because the natural capacitance to ground potential between the ionized gas and its surroundings is employed. A low voltage, high frequency potential is applied to the single cathode element which, in the presence of a low enough reactive impedance to the high frequency energy, causes plasma ignition of the gas. This property and approach allows much more control over the gas within the tube and its manner of ionization than in prior art displays, as will be described shortly. For example, the ignited plasma can be made to travel along the tube creating a defined bright and dark band. This can be a preprogrammable event where the plasma ignites, travels steadily to the end of the tube, and then repeats the process thus creating a unique handwriting effect in light. The position of ignition and termination can be automatically or manually controlled. Varying voltage levels such as those from the output of an audio amplifier can also be made to vary the plasma lighting discharge effect. Such possibilities and capabilities, of course, greatly enhance the attention gaining ability of signs and similar displays wherein they are incorporated. As will be seen, the present invention also provides the capability of producing multiple segments without the necessity of employing duplicate components as in the prior art.

Figures 1, 2, 3:
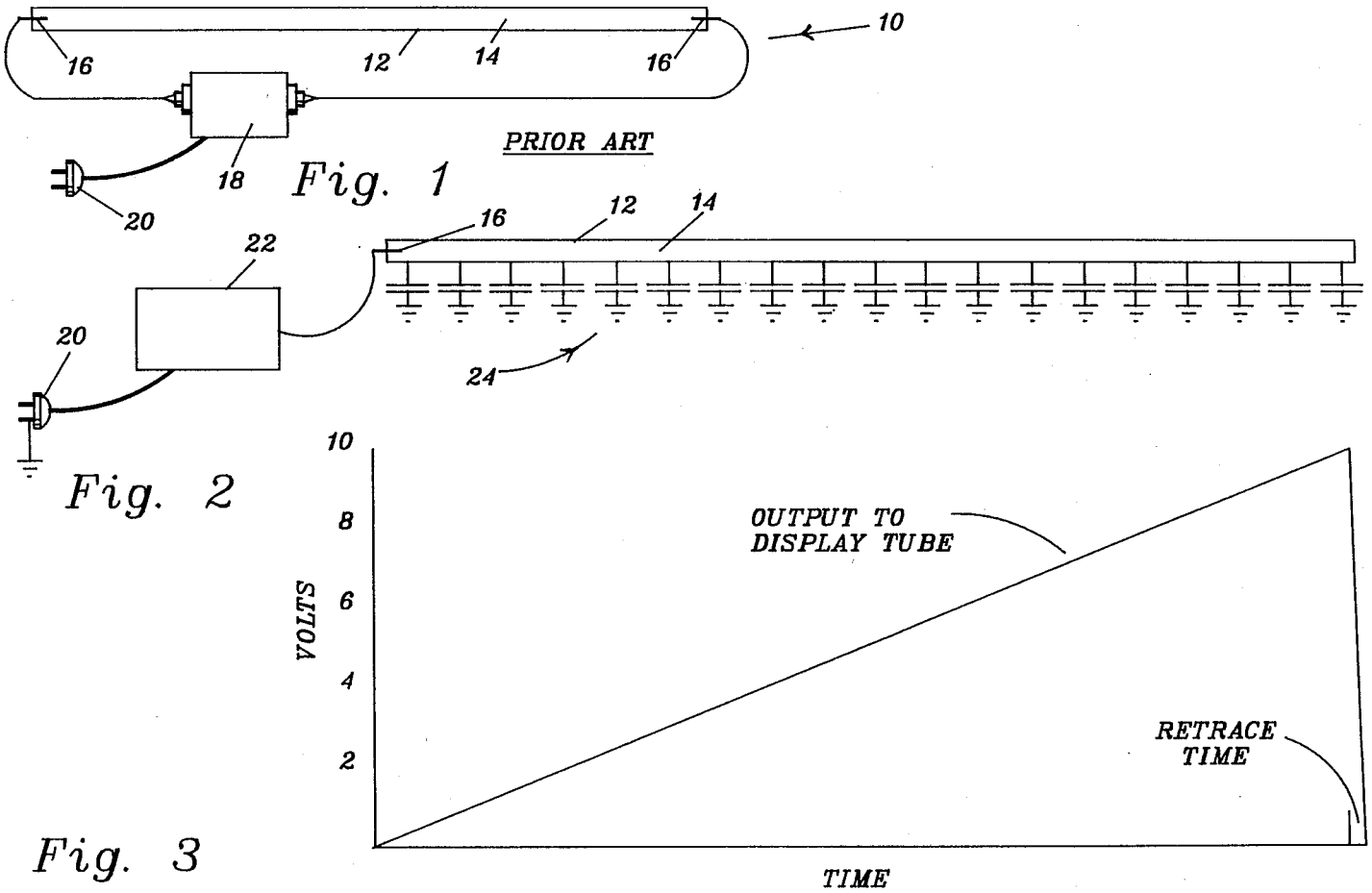
FIG. 1 is a simplified drawing of a prior art gas discharge tube display of the "neon sign" variety.
FIG. 2 is a simplified drawing showing the manner of operation of the present invention.
FIG. 3 is a graph of the voltage ramp applied to the single cathode element in the present invention.

Turning first to FIGS. 2 and 3, the principle of operation of the present invention will be described briefly. As in the prior art, a display tube 12 of glass, or the like, containing an ionizable gas 14 is employed. As single cathode element 16 is required at one end. As can be appreciated, old prior art tubes can be employed with the present invention by simply ignoring the cathode element 16 at the opposite end. The single cathode element 16 is connected to the output of a power source 22 which produces high frequency, low voltage referenced to ground potential and of sufficient frequency to cause the gas to ionize through the natural surrounding capacitance between the ionized gas and ground potential as represented by the capacitors generally indicated as 24. The power source 22 is connected to a conventional 110 volt 60 Hz power outlet by means of plug 20. The only requirement for the power outlet being that it be polarized with one side referenced to earth ground. As shown in FIG. 3, the preferred output of the power source is a high frequency voltage ramp that increases over time so as to move the ionization point along the tube 12 from one end to the other. As in a television tube, the voltage output drops to a "zero" state (i.e. no ionization of the gas 14 taking place) in a very short period indicated in the figure as the "retrace time" and then repeats the pattern of FIG. 3.

Figure 4:
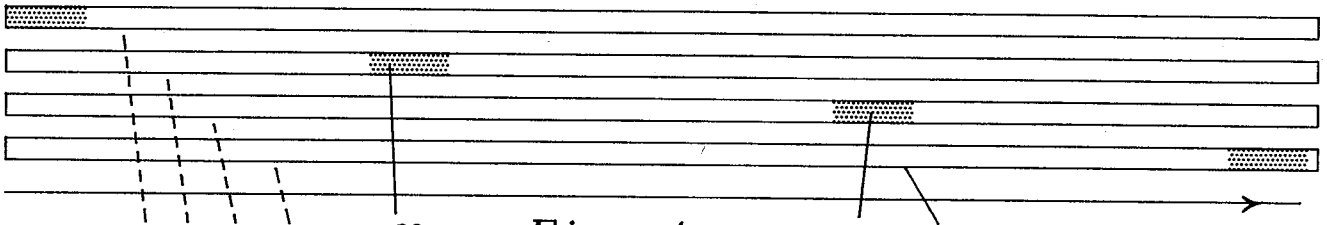
FIGS. 4(*a*), 4(*b*), 4(*c*), and 4(*d*) show the progress of ionization of the gas in the tube according to a first manner of operating the present invention.
Figure 5:
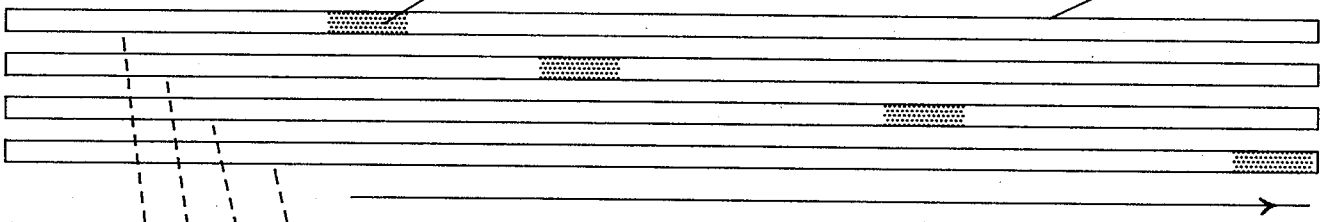
FIGS. 5(*a*), 5(*b*), 5(*c*), and 5(*d*) show the progress of ionization of the gas in the tube according to a second manner of operating the present invention.
Figure 6:
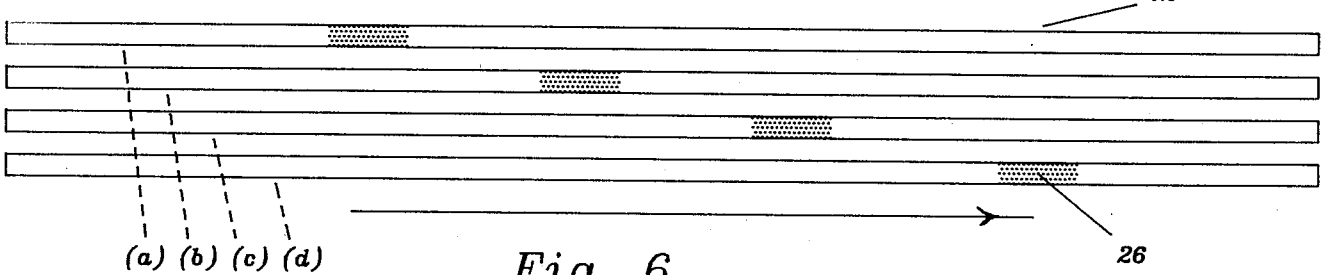
FIGS. 6(*a*), 6(*b*), 6(*c*), and 6(*d*) show the progress of ionization of the gas in the tube according to a third manner of operating the present invention.

By varying the initial and final voltage levels of the ramp of FIG. 3 which represents the output of the power source 22 applied to the single cathode element 16 of the display tube 12, various display features as depicted in FIGS. 4–6 can be achieved. As will be appreciated, these features cannot be achieved in the prior art and afford many possibilities for the display of the present invention. For example, in the sequence of FIGS. 4(*a*), 4(*b*), 4(*c*), and 4(*d*), the ionization point 26 is seen to move along the tube as a bright band of illumination fully from one end of the tube to the other; that is, from the end of the single cathode element to the other. In the sequence of FIGS. 5(*a*), 5(*b*), 5(*c*), and 5(*d*), the ionization point 26 move along the tube from an initial point displaced from the cathode element end of the tube fully to the other end. In the sequence of FIGS. 6(*a*), 6(*b*), 6(*c*), and 6(*d*), the ionization point 26 move along the tube from an initial point displaced from the cathode element end of the tube to a point short of the other end. As this last example illustrates, the present invention allows any segment of the tube between first and second preselected points to be selectively illuminated. As will be appreciated by those skilled in the art, therefore, by changing the points of illumination initiation and termination, the segment of the tube 12 being illuminated can be made to change.

Figure 7:
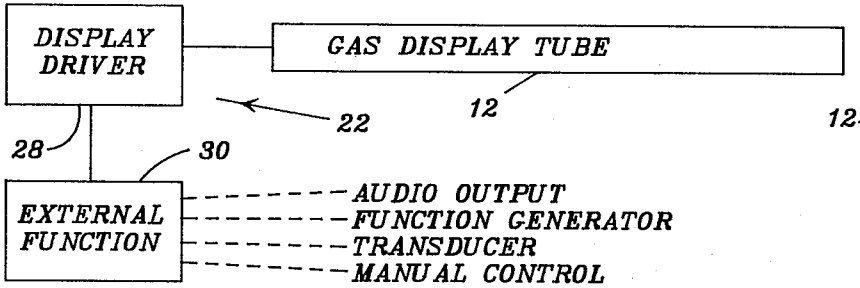
FIG. 7 is a block diagram showing how the present invention can be employed to selectively illuminate the display tube according to various possible external functions.

As illustrated in FIG. 7, in the preferred embodiment of the present invention, the display driver portion power source 22 of the present invention is made responsive to various external functions as represented by the box 30 connected thereto. Thus, the output of an audio amplifier can be employed to change the voltages of the power source 22 or modulate the frequency thereof so as to create display patterns with the tube 12 which are a function of the audio signal. A function generator can be employed to create particular display patterns and sequences. A transducer can be employed for certain uses. For example, a force transducer could change the position of the illumination of a tube disposed next to a scale so as to create an indicator for force measurement or a scale for weighing. A manual control can be employed for manually setting the position of illumination as, for example, to move the illuminated portion of the tube to selectively light up "OPEN" and "CLOSED" portions of a sign at a business.

Figure 8A:
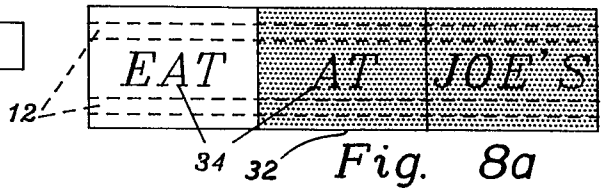
FIG. 8 is a simplified drawing showing how the present invention can be used to progressively illuminate portions of a display having indicia thereon with only a single tube.
Figure 8B:
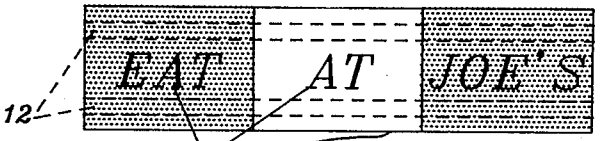
Figure 8C:
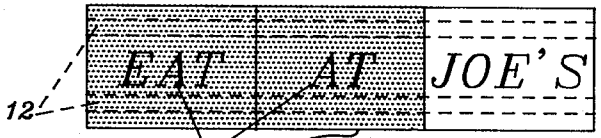

A display system according to the present invention which would not have possible in the prior art without elaborate controls sequencing between multiple tubes is shown in FIG. 8. A single tube 12 connected to the power source of the present invention (not included in the figure for simplicity) is disposed behind a display panel or sign 32 of translucent material and having indicia 34 thereon conveying a message, such as the message of FIG. 8, EAT AT JOE'S. For larger signs, multiple tubes could be used in parallel. As shown in FIG. 8(*a*), the initiation and termination point for illumination of the tube(s) 12 is first set in the power source 22 so as to illuminate a first portion behind the word EAT. After a period of time, the initiation and termination point for illumination of the tube(s) 12 is next set in the power source 22 so as to illuminate the portion behind the word AT. After a similar period of time, the initiation and termination point for illumination of the tube(s) 12 is set to illuminate the portion behind the word JOE'S. The word JOE'S remains illuminated for its period of time and then the process repeats. The result is a visually perceptible sequence of separate illumination of the indiviadual words EAT—AT—JOE'S employing only one tube(s) and one power source.

Figure 9:
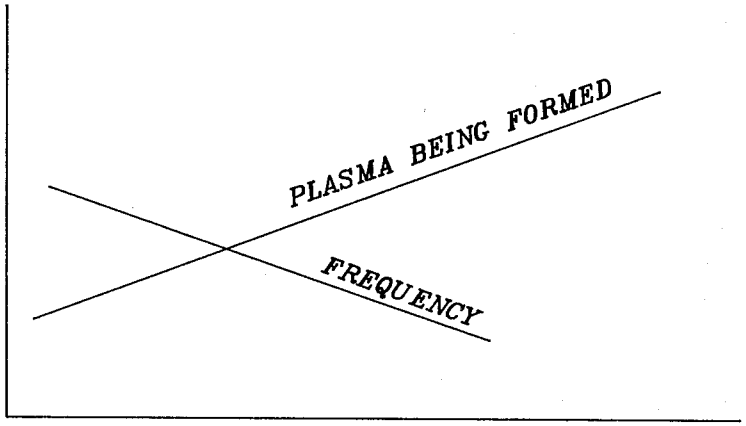
FIG. 9 is a simplified graph showing how in the preferred driver circuit of the present invention the frequency of the voltage ramp is decreased as the plasma being formed increases and correspondingly has more available capacitance to ground to automatically compensate for that phenomenon.

Another feature of the present invention as incorporated into the tested circuitry of the power source to be described shortly is illustrated in the simplified graph of FIG. 9. As the plasma in the display tube is ionized the available capacitance to ground increases in proportion to the quantity of gas within the tube which is ionized. To compensate for that natural effect, the preferred embodiment of the present invention correspondingly reduces the frequency of the voltage ramp to adjust for the change in available capacitance and thereby retain linear response to the output of the power source.

Figure 10:
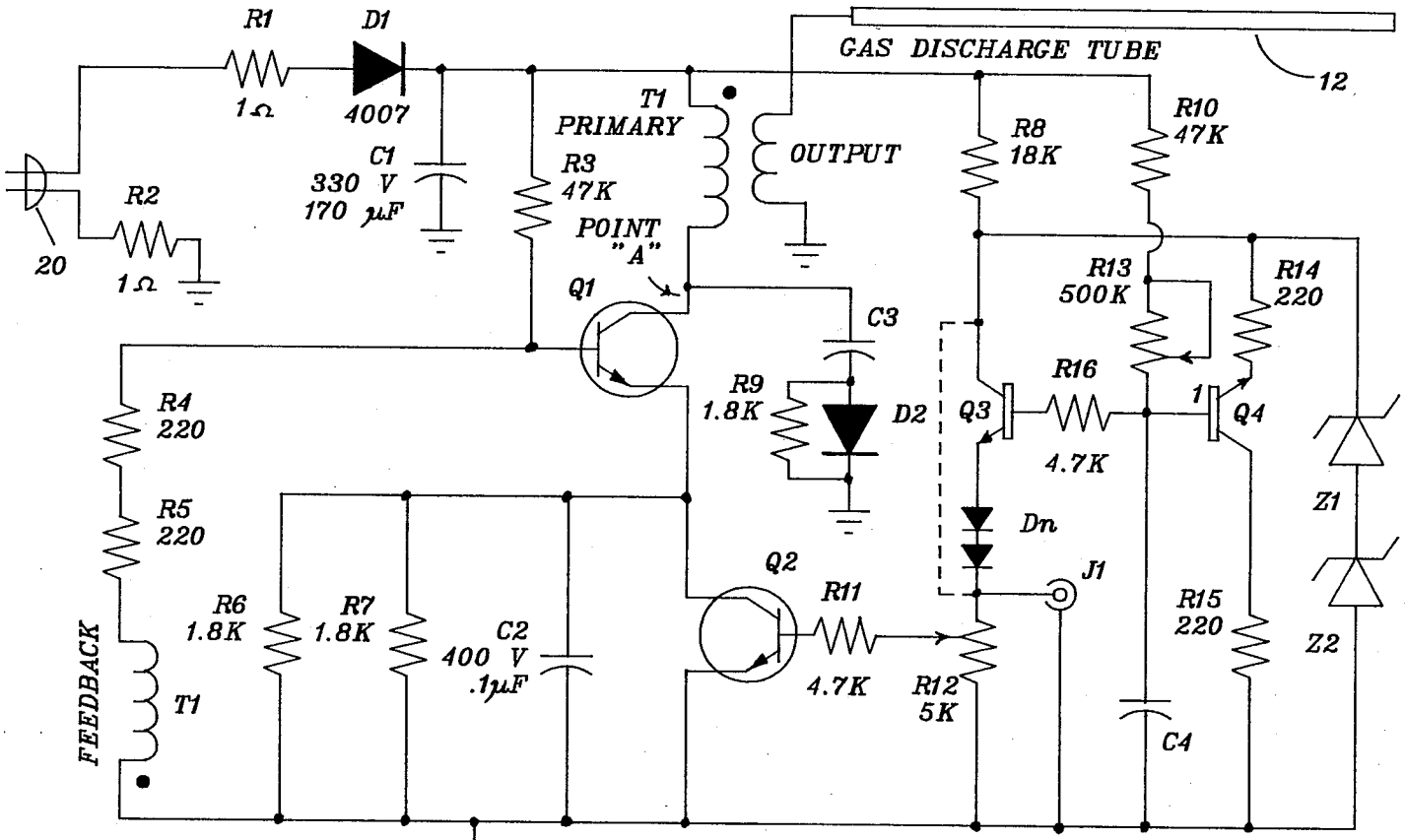
FIG. 10 is a circuit diagram of a circuit as employed in a tested embodiment of the present invention.

A circuit for the power source to drive a display tube according to the present invention as employed in tested embodiments by the applicant is shown in FIG. 10. While the construction and operation of the circuit should be apparent to those skilled in the art from an inspection thereof, a brief explanation will now be provided to assure complete understanding. More particularly, the circuit of FIG. 10 operates as follows.

The plug 20 is plugged into a conventional 110 volt, 60 Hz power outlet. Note, however, that plug 20 must be of the polarized variety wherein one side is referenced to actual ground potential as where a rod at the power pole or otherwise is driven into the earth. This is to say, since the capacitance to ground of the gas in the tube is to be employed, a so-called "floating ground" approach cannot be employed with the circuit of FIG. 10. The 110 volts AC is rectified by diode D1 and filtered by capacitor C1. Resistors R1 and R2 serve as "fuse" resistors and open up in the event of a catastrophic fault. The rectified voltage across C1 is approximately 160 volts DC. Transistor Q1 may be a MJE8501 power tab version and is connected as a Hartly type oscillator where the collector is in series with the primary of transformer T1 and is energized by the rectified DC voltage. A drive signal to the base is obtained by a tertiary feedback winding properly phased to allow oscillation to take place. Base current is limited by resistors R4 and R5 and biased into conduction by resistor R3. The oscillations produced are at a frequency of approximately 20 KHz. This is generally determined by the resonant frequency of T1. A snubbing circuit consisting of C3, R9 and D2 limits the change in voltage with respect to time (i.e. dv/dt) that may occur across Q1 along with any extreme peak voltages.

The gain of Q1, and hence the circuit output, is controlled via the conductance of pass transistor Q2 by biasing its base. In tested embodiments of the applicant, the waveshape at point "A" was a negatively clipped sine wave of 800 volts peak voltage and with a period of 50 microseconds. Resistors R6 and R7 guarantee low level oscillation even when Q2 is in a low or non-conductive state and should be set at 30 to 50 ma of AC line current. Q2 is biased through the "slope" control potentiometer R12 by setting its base current. Diode Dh prevents any offset voltage that may occur at the beginning of the turn-on cycle from turning on Q2. Capacitor C2 bypasses any high frequency signal across Q2.

The output of the circuit is controlled by the ramp voltage occurring a the emitter junction of pin 1 on Q4. This is a ramp function whose period is determined by the setting of R13 and capacitor C4. The actual time is a result of a constant current charge increasing voltage at the emitter of Q4 to a value where breakover occurs. This breakover or discharge happens in a relatively short period of time and is the retrace time of the ramp waveform as indicated in the graph of FIG. 3.

This voltage waveform is applied to emitter follower Q3 that is necessary to provide a relatively high impedance to the charging current integrated into C4. This impedance is greater than the beta of Q3 times the parallel combination of R11 and R12. This value remains relatively constant and does not appreciably change the ramp period. A voltage produced across R12 now follows the ramp voltage and turns on Q2 accordingly, providing a relatively linear change in the power output of Q1. Proper biasing of Q2 is to the point of conducting just when the ramp voltage starts to increase. This provides a minimum or zero display at this initial time which steadily increases as the ramp wave builds. R12 now controls the slope of this voltage rise and provides and adjustment for larger or shorter displays. R14 and R15 are necessary for proper biasing of unijunction Q4 while zener diodes Z1 and Z2 limit the voltage across Q3 and Q4 to 24 volts DC. The external jack J1 is provided for the attachment of the output signal from an audio amplifier or the like. The periodic waveform of the audio signal from the audio amplifier modulates the frequency output from the circuit and, accordingly the display tube being driven thereby. The modulation is accomplished by varying the emitter bias point of Q1 via the conductance of Q2. The control potentiometer R12 allows presetting the limit of the ionization energy per volt of input signal.

The plasma arc of the display is formed by the electrical current flowing through the gas in the tube. The atoms of the gas become energized to a level where electrons and positively charged atoms are produced. These emit light spontaneously upon returning to their initial energy state. A definite threshold for ionization is required, therefore causing a positive line of demarcation where ignition occurs. As the electrical current is reduced, the display shortens due to insufficient energy to cause further ionization. Increasing ionization energy causes the end of the display to lengthen since conduction can now occur due to more free charges. In simple quantitative terms, the number of charges produced in the tube is directly related to the input energy. A smaller volume tube would theoretically produce a longer discharge for a given ionization energy and vice versa. This, of course, neglects the change in dynamic impedance of the system due to a volume change.

In order to achieve a travelling plasma effect or discharge that moves along the display length, it is necessary to periodically control the ionization energy output of the circuit. As was stated above, transistor Q2 controls the output of the oscillator. This is accomplished by controlling its base and, therefore, controlling it conductivity. Proper operation of a system requires ignition just starting to occur and steadily increasing to the full length of the display being coincidental to the waveform. This requires a ramp of voltage injected into the base of Q2 steadily increasing to the desired point and thus resetting to repeat agian. This produces a writing effect in the display sign eventually resetting to the beginning and then repeating. The circuit of FIG. 10 is adapted to produce such a repeating ramp voltage. Capacitor C4 is charged through resistors R13 and R10. R13 is variable to control this charging current and, consequently, the repeat time which, for the handwriting effect, should be visually perceptible. Since the charging voltage is relatively high, a linear increase in voltage is produced in the form of a ramp before discharging through the emitter base junction of Q4. This discharge time is short in comparison to the ramp and produces a rapid reset of the display to its initial state. The ramp voltage is fed to Q2 through emitter follower Q3. This combination provides a high impedance allowing a minimal bypassing of the charging current. Zener diodes Z1 and Z2 limit the voltage supplied to Q3 and Q4 through resistor R8. A negative offset to guarantee a zero collector current through Q2 is provided by diode offset Dn biasing its base below conduction.

The above-described circuit is intended to fully ignite a display, periodically repeating it at an adjustable rate and retracing back to the beginning. Those skilled in the art will appreciate and understand the modifications which could be made thereto to accomplish other features as described hereinbefore and other possible features not described but within the scope and spirit of the present invention. For example, installing the jumper across Q3 indicated by the dotted line in the circuit diagram of FIG. 10, allows one to steady state position the plasma ignition to any point along the display tube by means of R12.

Wherefore, having thus described my invention, I claim:

1. In an elongated cold cathode gas discharge tube containing an ionizable gas and power source to ionize the gas to cause illumination thereof, the improvement comprising:

(a) the gas discharge tube having a single cathode element at one end in contact with the gas; and, (b) the power source being connected to said single cathode element and producing alternating voltage referenced to ground potential and of sufficient frequency to cause the gas to ionize through the natural surrounding capacitance between the ionized gas and ground potential; wherein the power source producing an increasing voltage ramp output whereby the ionization of the gas in the tube moves as a localized ionization along the tube in a direction away from said single cathode element.

2. The improvement of claim 1 wherein:

said voltage ramp starts at a level to cause initial ionization of the gas adjacent said single cathode element.

3. The improvement of claim 1 wherein:

said voltage ramp rises to a level to cause final ionization of the gas adjacent the end of the tube oppose said single cathode element.

4. The improvement of claim 1 wherein:

(a) said voltage ramp starts at a level to cause initial ionization of the gas adjacent said single cathode element; and, (b) said voltage ramp rises to a level to cause final ionization of the gas adjacent the end of the tube oppose said single cathode element and rises at a rate to produce a visible progression of illumination from one end of the tube to the other whereby an illuminated handwriting effect is created by the progressive illumination of the tube.

5. The improvement of claim 1 wherein:

(a) said voltage ramp starts at a level to cause initial ionization of the gas at a first selected point on the tube; and, (b) said voltage ramp rises to a level to cause final ionization of the gas at a second selected point on the tube displaced from said first point whereby only a selected portion of the tube is illuminated.

6. The improvement of claim 1 wherein:

said power source includes means for setting the beginning and ending voltages of said voltage ramp so that said selected illuminated portion of the tube is adjustable.

7. The improvement of claim 6 wherein:

said voltage setting means is an manually adjustable means for setting the position of said selected illuminated portion of the tube.

8. The improvement of claim 6 wherein:

said voltage setting means is connected to an audio source and adjusts said beginning and ending voltages as a function of an audio signal from said audio source whereby the position of said selected illuminated portion of the tube varies as a function of said audio signal.

9. The improvement of claim 1 wherein:

said power source includes means connected to an audio source for modulating the frequency of said voltage ramp as a function of an audio signal from said audio source so that said selected illuminated portion of the tube varies as a function of said audio signal.

10. The improvement of claim 1 wherein:

said power source includes means for reducing the frequency of said voltage ramp as more gas is ionized to offset the effect of an increased available natural capacitance to ground associated with the increased quantity of ionized gas.

11. The improvement of claim 1 wherein:

said power source includes means for setting the frequency of said voltage ramp as a function of the natural capacitance to ground of the gas whereby to automatically compensate for variations in said capacitance as more or less gas is ionized.

12. The improvement of claim 1 wherein:

said power source includes means for repeatably producing said voltage ramp so as to ionize the gas in the tube repeatedly in a strobing manner.

13. The improvement of claim 12 wherein:

said power source includes means for adjusting the repetition rate of said voltage ramp.

14. An illuminated display comprising:

(a) an elongated cold cathode gas discharge tube containing an ionizable gas, said tube having a single cathode element at one end in contact with said gas; and, (b) a power source connected to ionize the gas and cause illumination thereof, said power source being connected to said single cathode element and producing alternating voltage referenced to ground potential and of sufficient frequency to cause the gas to ionize through the natural surrounding capacitance between the ionized gas and ground potential; wherein the power source produces an increasing voltage ramp output whereby the ionization of the gas in the tube moves as a localized ionization along the tube in a direction away from said single cathode element.

15. The illuminated display of claim 14 wherein:
said voltage ramp starts at a level to cause initial ionization of the gas adjacent said single cathode element.

16. The illuminated display of claim 14 wherein:
said voltage ramp rises to a level to cause final ionization of the gas adjacent the end of the tube oppose said single cathode element.

17. The illuminated display of claim 14 wherein:
(a) said voltage ramp starts at a level to cause initial ionization of the gas adjacent said single cathode element; and,
(b) said voltage ramp rises to a level to cause final ionization of the gas adjacent the end of the tube oppose said single cathode element and rises at a rate to produce a visible progression of illumination from one end of the tube to the other whereby an illuminated handwriting effect is created by the progressive illumination of the tube.

18. The illuminated display of claim 14 wherein:
(a) said voltage ramp starts at a level to cause initial ionization of the gas at a first selected point on the tube; and,
(b) said voltage ramp rises to a level to cause final ionization of the gas at a second selected point on the tube displaced from said first point whereby only a selected portion of the tube is illuminated.

19. The illuminated display of claim 14 wherein:
said power source includes means for setting the beginning and ending voltages of said voltage ramp so that said selected illuminated portion of the tube is adjustable.

20. The illuminated display of claim 19 wherein:
said voltage setting means is an manually adjustable means for setting the position of said selected illuminated portion of the tube.

21. The illuminated display of claim 19 wherein:
said voltage setting means is connected to an audio source and adjusts said beginning and ending voltages as a function of an audio signal from said audio source whereby the position of said selected illuminated portion of the tube varies as a function of said audio signal.

22. The illuminated display of claim 14 wherein:
said power source includes means connected to an audio source for modulating the frequency of said voltage ramp as a function of an audio signal from said audio source so that said selected illuminated portion of the tube varies as a function of said audio signal.

23. The illuminated display of claim 14 wherein:
said power source includes means for reducing the frequency of said voltage ramp as more gas is ionized to offset the effect of an increased available natural capacitance to ground associated with the increased quantity of ionized gas.

24. The illuminated display of claim 14 wherein:
said power source includes means for setting the frequency of said voltage ramp as a function of the natural capacitance to ground of the gas whereby to automatically compensate for variations in said capacitance as more or less gas is ionized.

25. The illuminated display of claim 14 wherein:
said power source includes means for repeatably producing said voltage ramp so as to ionize the gas in the tube repeatedly in a strobing manner.

26. The illuminated display of claim 25 wherein:
said power source includes means for adjusting the repetition rate of said voltage ramp.

27. The illuminated display of claim 18 and additionally comprising:
(a) a display panel containing indicia thereon disposed to be illuminated by said tube; and,
(b) means for repeatably changing said first and second points to cause said display panel to be cyclically illuminated in portions disposed over said tube between said changing first and second points.

28. The illuminated display of claim 27 wherein:
said means for repeatably changing said first and second points includes means for changing said points at a rate to produce a visibly perceptible stepping between said portions of said display panel being illuminated.

29. The improved method of causing illumination of an elongated cold cathode gas discharge tube containing an ionizable gas and having a single cathode element at one end in contact with the gas comprising the steps of:
(a) connecting an alternating voltage referenced to ground potential and of sufficient frequency to cause the gas to ionize through the natrual surrounding capacitance between the ionized gas and ground potential to the single cathode element; and
(b) ramping the voltage between first and second levels whereby the ionization of the gas in the tube moves as a localized ionization along the tube in a direction away from the single cathode element.

30. The method of claim 29 wherein said step includes:
starting the voltage ramp at a level to cause initial ionization of the gas adjacent the single cathode element.

31. The method of claim 29 wherein said step includes:
raising the voltage ramp to a level sufficient to cause final ionization of the gas adjacent the end of the tube oppose the single cathode element.

32. The method of claim 29 wherein said step includes:
(a) starting the voltage ramp at a level to cause initial ionization of the gas adjacent the single cathode element; and,
(b) raising the voltage ramp to a level sufficient to cause final ionization of the gas adjacent the end of the tube oppose the single cathode element and at a rate to produce a visible progression of illumination from one end of the tube to the other whereby an illuminated handwriting effect is created by the progressive illumination of the tube.

33. The method of claim 29 wherein said step includes:
(a) starting the voltage ramp at a level to cause initial ionization of the gas at a first selected point on the tube; and,
(b) raising the voltage ramp to a level to cause final ionization of the gas at a second selected point on the tube displaced from the point of initial ionization whereby only a pre-selected portion of the tube is illuminated.

34. The method of claim 29 wherein said step includes:

adjusts said beginning and ending voltages of the voltage ramp as a function of an audio signal whereby the position of the illuminated portion of the tube varies as a function of the audio signal.

35. The method of claim 29 wherein said step includes:

modulating the frequency of the voltage ramp as a function of an audio signal so that the illuminated portion of the tube varies as a function of the audio signal.

36. The method of claim 29 wherein said step includes:

reducing the frequency of the voltage ramp as more gas is ionized to offset the effect of an increased available natural capacitance to ground associated with the increased quantity of ionized gas.

37. The method of claim 29 wherein said step includes:

adjusting the frequency of the voltage ramp as a function of the natural capacitance to ground of the gas whereby to automatically compensate for variations in the capacitance to ground as more or less gas is ionized.

38. The method of claim 29 wherein said step includes:

repeatedly producing the voltage ramp so as to ionize the gas in the tube in a strobing manner.

39. The method of claim 38 wherein said step includes:

adjusting the repetition rate of the voltage ramp.

40. The method of claim 33 and additionally including the steps of:

(a) disposing a display panel containing indicia thereon to be illuminated by the tube; and, (b) repeatably changing the first and second points to cause the display panel to be cyclically illuminated in portions disposed over the tube between the changing first and second points.

41. The method of claim 40 wherein said steps include:

repeatably changing the first and second points at a rate to produce a visibly perceptible stepping between the portions of the display panel being illuminated.

* * * * *

US004742278B1

REEXAMINATION CERTIFICATE (3045th)

United States Patent [19] [11] B1 4,742,278

Iannini [45] Certificate Issued Nov. 5, 1996

[54] SINGLE CONNECTION GAS DISCHARGE DISPLAY AND DRIVER

[75] Inventor: Robert E. Iannini, Mount Vernon, N.H.

[73] Assignee: Bertonee Inc., Calgary, Canada

Reexamination Request:
No. 90/003,834, May 17, 1995

Reexamination Certificate for:

| | |
|---|---|
| Patent No.: | **4,742,278** |
| Issued: | **May 3, 1988** |
| Appl. No.: | **57,617** |
| Filed: | **Jun. 3, 1987** |

[51] Int. Cl.[6] ..... H05B 41/16

[52] U.S. Cl. ..... 315/248; 315/227 R; 315/236

[58] Field of Search ..... 315/248, 227 R, 315/236, 169.1, DIG. 4, DIG. 5, 219; 313/607

[56] References Cited

U.S. PATENT DOCUMENTS

| | | | |
|---|---|---|---|
| 3,440,488 | 4/1969 | Skirvin | 315/209 |
| 4,645,979 | 2/1987 | Chow | 315/169.1 |

FOREIGN PATENT DOCUMENTS 1250376 10/1971 United Kingdom .

*Primary Examiner*—Robert Pascal

[57] ABSTRACT

A new method and apparatus for driving a neon display tube or the like. The tube, containing an ionizable gas, has only a single cathode element at one end in contact with the gas. A power source connected to ionize the gas and cause illumination thereof wherein the power source is connected to the single cathode element and produces alternating voltage referenced to ground potential and of sufficient frequency to cause the gas to ionize through the natural surrounding capacitance between the ionized gas and ground potential. In the preferred embodiment, the power source produces an increasing voltage ramp output whereby the ionization of the gas in the tube moves as a localized ionization along the tube in a direction away from the single cathode element. The voltage ramp may start at a level to cause initial ionization of the gas adjacent the single cathode elements, rise to a level to cause final ionization of the gas adjacent the end of the tube oppose the single cathode element, and rise at a rate to produce a visible progression of illumination from one end of the tube to the other whereby an illuminated handwriting effect is created by the progressive illumination of the tube. Also, the voltage ramp may start at a level to cause initial ionization of the gas at a first selected point on the tube and rise to a level to cause final ionization of the gas at a second selected point on the tube displaced from the first point whereby only a selected portion of the tube is illuminated.

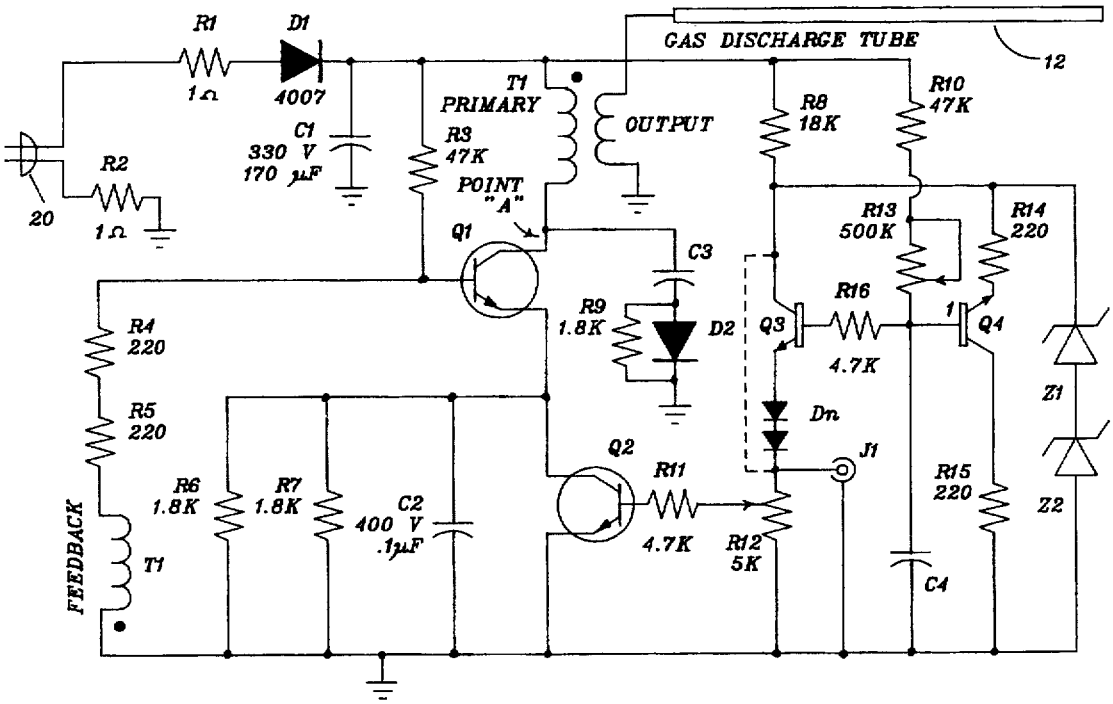

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 10, 11, 23, 24, 36 and 37 is confirmed.

Claims 1–9, 12–22, 25–35 and 38–41 are cancelled.

* * * * *